US007047966B2

(12) United States Patent
Stewart

(10) Patent No.: US 7,047,966 B2
(45) Date of Patent: May 23, 2006

(54) LIFESAVING FLOATATION AND BREATHING DEVICE

(76) Inventor: Robert E. Stewart, 2505 Highway 236, R.R. #1, Truro, Nova Scotia (CA) B2N 5A9

( * ) Notice: Subject to any disclaimer, the term of this patent is extended or adjusted under 35 U.S.C. 154(b) by 60 days.

(21) Appl. No.: 10/883,716

(22) Filed: Jul. 6, 2004

(65) Prior Publication Data

US 2006/0005831 A1 Jan. 12, 2006

(51) Int. Cl.
*B63C 11/02* (2006.01)
*B63C 9/08* (2006.01)
*A62B 18/08* (2006.01)

(52) U.S. Cl. ..... 128/201.27; 128/201.26; 441/88

(58) Field of Classification Search ..... 128/201.11, 128/201.26, 201.27, 201.28, 201.29; 405/185–187; 441/88, 90, 91, 92, 96, 111–114, 123
See application file for complete search history.

(56) References Cited

U.S. PATENT DOCUMENTS

| | | | | | |
|---|---|---|---|---|---|
| 371,781 | A | * | 10/1887 | Morgan | 441/91 |
| 1,114,739 | A | | 10/1914 | Dobinch | |
| 1,692,591 | A | | 11/1928 | Stelzner | |
| 1,878,474 | A | * | 9/1932 | Drager et al. | 128/202.14 |
| 2,742,654 | A | | 4/1956 | Hurt | |
| 2,831,607 | A | | 4/1958 | Berndt | |
| 3,046,576 | A | * | 7/1962 | Bernhardt | 441/92 |
| 3,486,730 | A | | 12/1969 | Potash | |
| 3,866,253 | A | | 2/1975 | Sinks et al. | |
| 3,877,425 | A | | 4/1975 | O'Neill | |
| 3,986,838 | A | | 10/1976 | Reichert | |
| 4,000,534 | A | * | 1/1977 | Cerniway et al. | 405/186 |
| 4,272,857 | A | * | 6/1981 | Oldham | 441/92 |
| 4,324,234 | A | | 4/1982 | Maness | |
| 4,389,961 | A | | 6/1983 | Parish | |
| 4,440,163 | A | | 4/1984 | Spergel | |
| 4,498,878 | A | | 2/1985 | Shieh | |
| 4,498,879 | A | | 2/1985 | Burr | |
| 4,498,882 | A | * | 2/1985 | Evert | 441/116 |
| 4,515,156 | A | | 5/1985 | Khudosovtsev et al. | |
| 4,560,356 | A | | 12/1985 | Burr | |
| 4,666,413 | A | | 5/1987 | Klein et al. | |
| 4,681,552 | A | * | 7/1987 | Courtney | 441/92 |
| 4,813,899 | A | * | 3/1989 | Fujimoto | 441/122 |
| 4,865,573 | A | * | 9/1989 | Switlik, Jr. et al. | 441/92 |
| 5,516,233 | A | | 5/1996 | Courtney | |
| 5,620,664 | A | | 4/1997 | Palmer | |
| 5,746,633 | A | * | 5/1998 | Jeffrey | 441/123 |

(Continued)

FOREIGN PATENT DOCUMENTS

| | | |
|---|---|---|
| CA | 2084765 | 11/1996 |

*Primary Examiner*—Teena Mitchell
(74) *Attorney, Agent, or Firm*—Mario Theriault

(57) ABSTRACT

This lifesaving floatation and breathing device comprises first and second inflatable bags having similar bag volumes, and a mouthpiece communicating with both bags. A pressurized gas cylinder filled with breathable gas is mounted to one of the bags. This pressurized gas cylinder has a gas volume and a gas pressure therein. The device also has an inflator mechanism mounted thereto for transferring the breathable gas from the pressurized gas cylinder into one of the bags. One of the characteristics of the device is that the volume of each bag is a mathematical product of the gas volume inside the cylinder and a ratio of the gas pressure inside the cylinder over atmospheric pressure. Either bags can accept the full content of the cylinder at atmospheric pressure, thereby obviating the need for a pressure regulator or flow control orifice therein.

20 Claims, 7 Drawing Sheets

U.S. PATENT DOCUMENTS 5,820,432 A * 10/1998 Wright ..... 441/119
5,887,585 A 3/1999 Dusenbery
5,979,442 A 11/1999 Orr
6,032,668 A 3/2000 Chung
6,070,546 A 6/2000 Downey et al.
6,179,677 B1 1/2001 Dornier
6,319,477 B1 11/2001 Du Toit
6,394,867 B1 5/2002 Bianco
6,412,482 B1 7/2002 Rowe
6,592,298 B1 7/2003 Beltrani
6,923,177 B1 * 8/2005 Hart ..... 128/201.27
2003/0060101 A1 3/2003 Parrott et al.

* cited by examiner

LIFESAVING FLOATATION AND BREATHING DEVICE

FIELD OF THE INVENTION

This invention pertains to lifesaving floatation devices inflated with respirable gas and having mouthpieces to breathe the gas therein. More particularly, it pertains to a floatation device having two inflatable compartments interconnected together through a valve arrangement that is sequentially positioned to inhale from one compartment and exhale into the other, and to re-breathe the previously-exhaled gas from the other compartment in order to extend the breathing period thereof.

BACKGROUND OF THE INVENTION

A lack of breathing air and a need for floatation are often combined in a same catastrophic event. For example, people trapped inside a submerged vehicle need breathing air to get out of the vehicle and added buoyancy to swim to the shore. Similarly, smoke inhalation and drowning are often combined risks in an air plane crash or in the case of a burning ship. Home owners living near flood plains could also be exposed to smoke inhalation from a house fire due to electrical short circuits caused by rising water, and drowning when evacuating their house during an inundation; Therefore it is believed that a need exists for a lifesaving device offering both floatation and oxygen supply for at least a short period of time.

Conventional lifesaving devices for use in homes, vehicles, cottages and small crafts are generally limited to containers of breathable gas, gas filters, floatation vests and inflatable rafts. Both a breathing aid and floatation equipment are purchased, stored and maintained separately and therefore, people often neglect to obtain one or the other or both.

Examples of emergency oxygen or air supply devices of the prior art are described in the following documents. These documents are divided in two groups. The documents in the first group pertain to devices used to filter ambient air delivered to a mouthpiece, and the documents in the second group pertain to devices incorporating a limited supply of breathable gas contained under pressure in a small cylinder. Examples of the devices of the prior art having a filter incorporated therein are as follows:

U.S. Pat. No. 4,515,156 issued to N. M. Khudosovtsev et al. on May 7, 1985;

U.S. Pat. No. 6,032,668 issued to C. Y. Chung on Mar. 7, 2000;

CA Patent 2,084,765 issued to L. J. Swann on Nov. 12, 1996.

Examples of breathing devices having a supply of respirable gas included therein are as follows:

U.S. Pat. No. 2,831,607 issued to A. J. Berndt on Apr. 22, 1958;

U.S. Pat. No. 4,440,163 issued to G. Spergel on Apr. 3, 1984;

U.S. Pat. No. 5,979,442 issued to R. J. Orr on Nov. 9, 1999;

U.S. Pat. No. 6,412,482 issued to C. D. Rowe on Jul. 2, 2002;

Both the filter and the pressurized cylinder types of breathing devices are advantageous to prevent inhalation of smoke or toxic gases for example for a period of time which is sufficiently long to allow a person to get away from a danger area. In the case of the CA Patent 2084,765 for example, a supply of breathable air for a period of 10 minutes is suggested. In another example, the U.S. Pat. No. 4,440,163 suggests a supply of respirable air for a period of about 5 minutes.

In regard to prior art in the field of inflatable lifesaving devices, the following documents represent good examples of floatation equipment that are inflatable by mouth of the user:

U.S. Pat. No. 2,742,654 issued to V. H. Hurt on Apr. 24, 1956;

U.S. Pat. No. 5,516,233 issued to W. L. Courtney on May 14, 1996;

U.S. Pat. No. 4,813,899 issued to H. Fujimoto on Mar. 21, 1989.

Although the above inflatable devices have a mouthpiece connected to one or more inflatable bags, each mouthpiece is equipped with a check valve that prevents re-breathing from the bags. These devices are therefore not appropriate for preserving someone's life in a hazardous situation requiring both floatation and respirable air.

More relevant prior art devices preceding the present invention consist of floatation vests, each being made of two compartments from which at least one contains respirable air and is equipped with a hose and a mouthpiece for inhaling the air from the bag. These floatation vests are described in the following documents:

U.S. Pat. No. 3,866,253 issued to A. J. Sinks et al. on Feb. 18, 1975;

U.S. Pat. No. 3,877,425 issued to W. J. O'Neill on Apr. 15, 1975;

U.S. Pat. No. 4,324,234 issued to S. G. Maness on Apr. 13, 1982.

In the case of U.S. Pat. No. 3,866,253, a diver wearing the vest can inflate one of the compartments by mouth, and where necessary, re-breathe the air from this compartment. The other compartment is inflated by a cartridge of compressed $CO_2$ gas. The U.S. Pat. No. 4,324,234 suggests a dual-chamber vest wherein one of the chambers is filled with compressed air or breathable gas and the other is filled with $CO_2$ gas. The document suggests an amount of air sufficient to re-breathe from the bag for a period of 3 to 5 minutes to escape from a danger situation.

One of the problems associated with a pressurized gas container used in a breathing device is that the discharge of the container into the bag of the device increases the pressure of the breathable gas inside the bag or vest and makes in difficult, at least initially, to control the flow of gas through a mouthpiece. The pressure surge of the discharging cylinder is susceptible of causing a wearer to inadvertently over-breathe or otherwise let escape a substantial amount of gas through the mouthpiece, and to waste a portion of the lifesaving feature of the device. Therefore conventional breathing apparatus using pressurized cylinders have pressure regulators incorporated therein or calibrated orifices to limit the flow of gas to the mouthpiece.

However, a pressure regulator mounted in a lifesaving breathing device increases the manufacturing cost of the device and is believed to be a determining factor limiting the accessibility of the device to a large number of people. Similarly, the use of an orifice in a breathing device limits the amount of air available to the user at any given time. As the pressure drops in the supply cylinder, the flow of gas also drops across the orifice and to the mouthpiece. This reduction of flow to the mouthpiece could induce a sense of panic to the user.

On the other hand, when the respirable gas is expanded in a bag at atmospheric pressure, it is estimated that a volume of gas of about 660 cubic inches is required for each minute of breathing time. A bag containing 3 to 5 minutes worth of breathable gas can be seen as a serious encumbrance to get out of a cramped space in a danger situation.

As such, it may be appreciated that there continues to be a need for a new and improved lifesaving floatation and breathing device having a reasonable volume of breathable air therein and which operates without a pressure regulator or an orifice.

SUMMARY OF THE INVENTION

The floatation and breathing device according to the present invention is inflated from a pressurized cylinder containing breathable gas. The breathable gas is discharged into a bag having an appropriate volume to accept the full content of the cylinder at atmospheric pressure, thereby obviating the need for a pressure regulator or flow control orifice.

In a broad aspect of the present invention, there is provided a lifesaving floatation and breathing device comprising first and second inflatable bags having similar bag volumes, and a mouthpiece communicating with both bags. A pressurized gas cylinder, or other container, filled with breathable gas is mounted to one of the bags. This pressurized cylinder has a nominal gas volume and a nominal gas pressure therein The device also has an inflator mechanism for transferring the breathable gas from the pressurized gas cylinder into one of the bags. In this device, the volume of each bag corresponds to a mathematical product of the nominal gas volume inside the cylinder and a ratio of the nominal gas pressure inside the cylinder over atmospheric pressure.

Therefore when the gas from the pressurized cylinder is transferred into the bag, this gas is easily breathable at atmospheric pressure. Also, the exhaled gas which still contains a substantial amount of oxygen is stored in the second bag for eventually re-breathing it. The buoyancy of the device is thereby maintained and the breathing period of the original breathable gas cylinder is substantially increased.

In another aspect of the present invention, there is provided a selector valve in communication with the mouthpiece, and hoses or conduits between the selector valve and each of the bags. The selector valve has a pair of check valves mounted therein communicating with the hoses or conduits and the mouthpiece to control a gas flow in the mouthpiece to and from the bags. The check valves are mounted inside a circular dial, in opposite air-flow orientations relative to each other. The dial is movable relative to the base of the selector valve from a first position to a second position. In the first position, the check valves allow inhaling oxygen gas from the first bag and exhaling into the second bag. In the second position, the check valves allow the re-breathing of the previously exhaled gas, and exhaling in the first bag. Although the oxygen content in the first exhaled gas is somewhat reduced, it is believed to be appropriate for re-breathing again in a life threatening situation.

It will be appreciated that when the first-inhaled gas is rich in oxygen, the position of the selector valve can be inverted several times, to allow re-breathing gas from the inflated bag and to exhale and inflate the other bag, until the exhaled gas reaches a minimum breathable oxygen content.

In another aspect of the present invention, each bag has the shape of a horseshoe having a first end and a second end. The pressurized cylinder has means to introduce the breathable gas in the first end of the first bag and the selector valve is in communication with the other end of that same bag. Because of these opposite mountings, a pressure surge inside the bag when the gas from the cylinder is introduced into the bag all at once has negligible effect on the gas pressure at the mouthpiece.

In yet another aspect of the present invention, there is provided a floatation and breathing device comprising a front bag and a rear bag each having an upper end and a lower end, and a mouthpiece mounted to the upper ends. The bags share a common membrane and jointly define the shape of a pillow. In this embodiment, the pressurized cylinder has means to introduce the breathable gas in the lower end of the front bag. Again, the pressure surge from discharging the pressurized cylinder inside one of the bags has little effect on the gas pressure at the mouthpiece. Furthermore, the pressure surge caused by the discharging of the gas cylinder into one of the bags when the bags are in a folded form, helps to expand the bags from their folded form.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

Two embodiments of the present invention are illustrated in the accompanying drawings, in which like numerals denote like parts throughout the several views, and in which.

DESCRIPTION OF THE PREFERRED EMBODIMENTS

Figure 1:
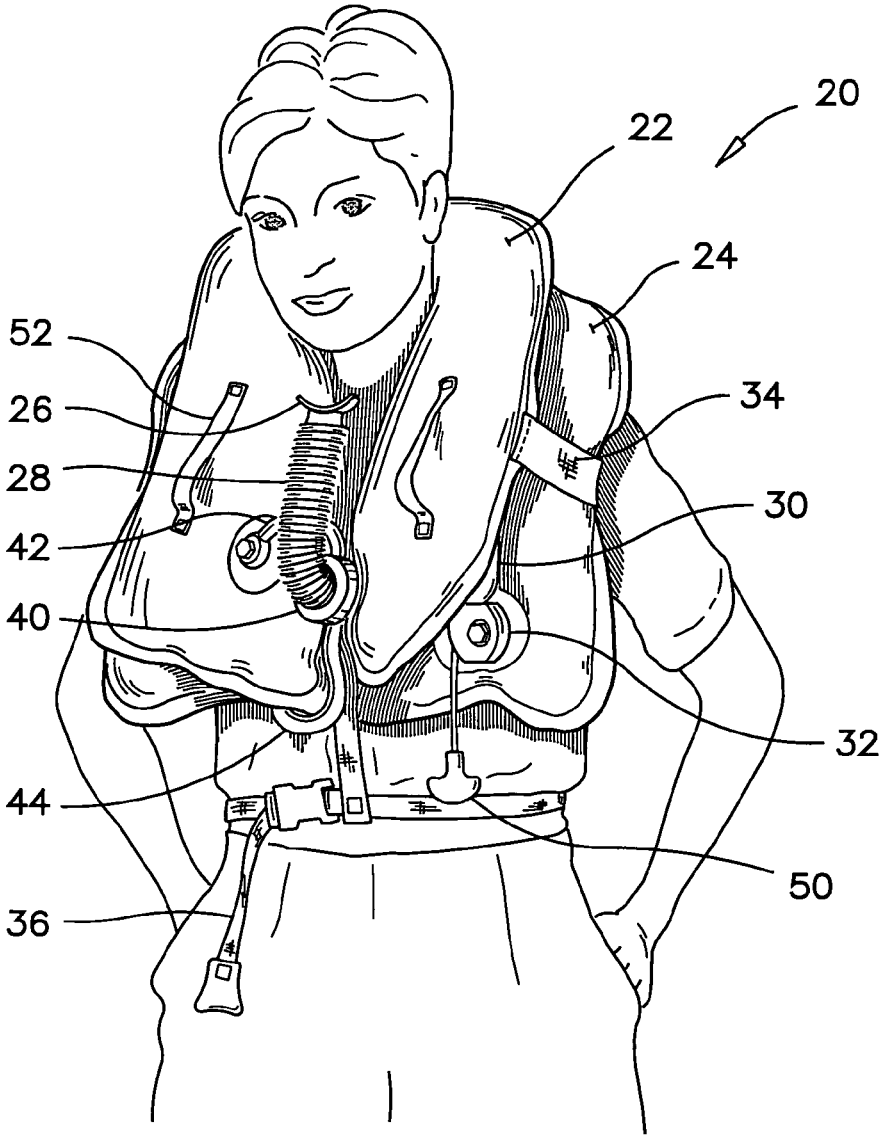
FIG. 1 is a perspective front and side view of the floatation and breathing device according to the first preferred embodiment of the present invention, worn by a user.
Figure 2:
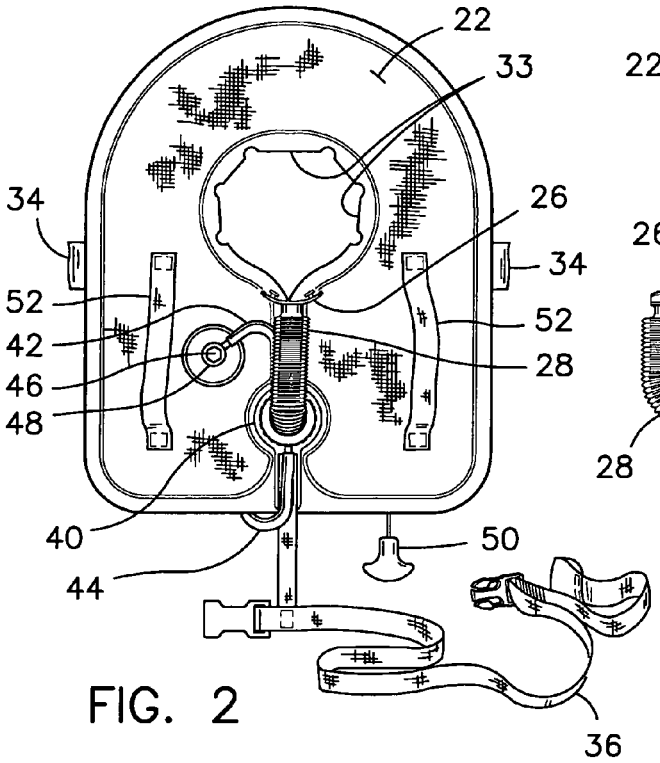
FIG. 2 is a front view of the first preferred floatation and breathing device.
Figure 3:
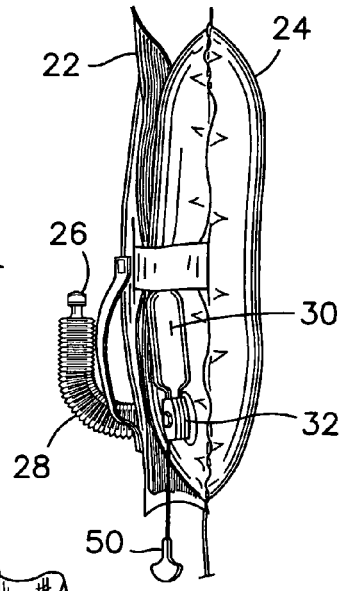
FIG. 3 is a side view of the first preferred floatation and breathing device, showing the front bag in a deflated mode and the rear bag in an inflated mode.
Figure 4:
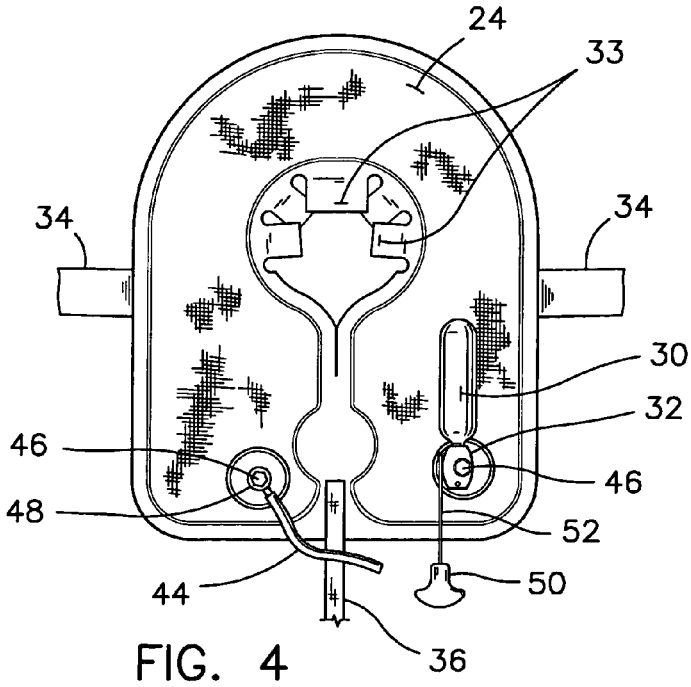
FIG. 4 is a front view of the rear bag of the first preferred floatation and breathing device as seen when separated from the front bag.
Figure 5:
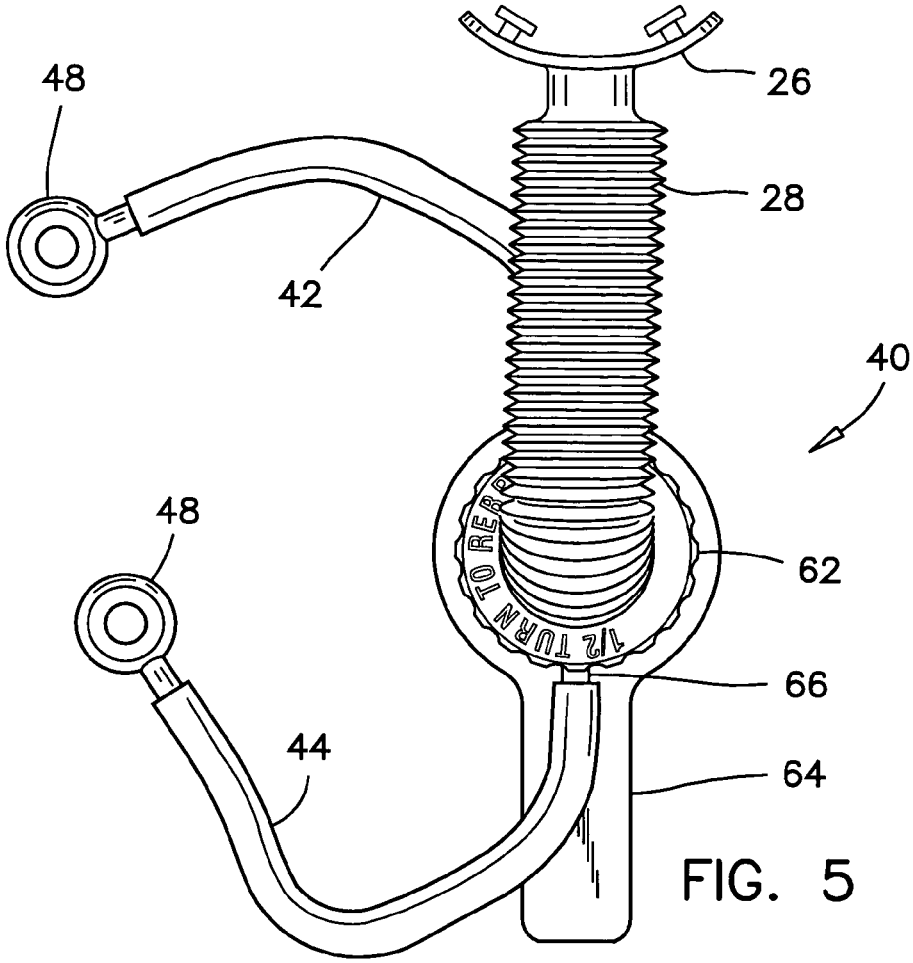
FIG. 5 is a front view of the mouthpiece, the extensible hose and selector valve mountable to the first preferred embodiment of the preferred invention.
Figure 6:
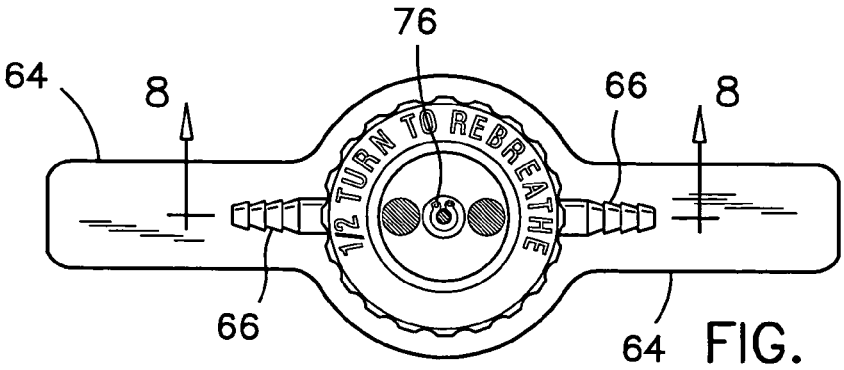
FIG. 6 is a front view of the selector valve shown in FIG. 5 without the extensible hose and mouthpiece.
Figure 7:
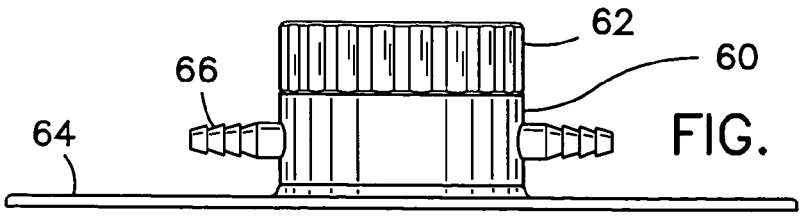
FIG. 7 is a side view of the selector valve shown in FIG. 6.

While this invention is susceptible of embodiment in many different forms, there are shown in the drawings and will be described in details herein two specific embodiments, with the understanding that the present disclosure is to be considered as an example of the principles of the invention and is not intended to limit the invention to the embodiments illustrated and described.

The floatation and breathing device according to the first preferred embodiment is illustrated in FIGS. 1 to 9. This first preferred floatation and breathing device 20 has the form of a life vest and can be worn by a user. This first preferred embodiment is also referred to herein as the life vest 20.

The life vest 20 is made of a front bag 22 and a rear bag 24. The front bag 22 is separate from the rear bag 24. The front bag 22 is inflatable with exhaled air by the user, by mean a mouthpiece 26 and a flexible and extensible tube 28. The rear bag 24 is inflatable with oxygen by means of a high pressure gas cylinder 30 and a manual inflator 32. Each bag has the shape of a horseshoe with a central hole and two lower ends on opposite sides thereof. The gas cylinder 30 preferably contains a breathable gas mixture having a high oxygen content, such as 90% oxygen for example.

Referring particularly to FIGS. 1 to 4, the front bag 22 and the rear bag 24 are retained to each other by central tendons 33 extending around the central hole or the neck of the life vest, and by a pair of side tendons 34 extending from the sides of the life vest. A belt 36 is also provided and is fastened to the lower front end of the life vest 20. In use, the life vest 20 is worn as a bib and is attached to the waist of the user as illustrated in FIG. 1.

The life vest 20 also comprises a selector valve 40 communicating with both bags 22, 24 by way of two hoses. The hose mounted to the front bag 22 is referred to as the exhaled air hose and is labelled 42. The hose mounted to the rear bag 24 is referred to as the oxygen hose and is labelled 44. The oxygen hose 44 is mounted at one end of the horseshoe shape on the rear bag 24, and the pressurized gas cylinder 30 and the manual inflator 32 are mounted at the opposite end of that same bag.

Each of the hoses 42, 44 is mounted to a respective bag using a manifold stem valve 46 such as a stem valve, part no. 830 AOE manufactured by Halkey-Roberts™, in which the valve spring and mechanism have been removed, and a corresponding eye-ring fitting 48 at the end of each hose, enclosing the stem valve 46. The manual inflator 32 is also mounted to a manifold valve 46 as specified above without modification. The manual inflator 32 is also available from a selection of different inflators manufactured by Halkey-Robert™, or other manufacturers. The preferred inflator 32 is operable by pulling on a handle 50 which is tied to the inflator's mechanism by a string 52. The preferred inflator 32 is labelled as part 840 AM. Halkey-Roberts™ is located in St-Petersburg, Fla., USA.

The high-pressure cylinder 30 has a preferred volume of about 4.85 cubic inches and contains oxygen-rich breathable gas at a pressure of about 2000 psi. Both bags 22, 24 have a respective volume of about 660 cubic inches.

When the breathable gas from the cylinder is released in the rear bag 24, this bag is inflated to a pressure that is substantially the same as the atmospheric pressure. Therefore, there is no need for a pressure regulator or a flow control orifice to control the flow of gas to the mouthpiece 26. This breathable gas is readily available for breathing, through the oxygen hose 44 and the selector valve 40. A volume of 660 cubic inches is believed sufficient to provide breathable gas to a person for a period of about one minute.

Because the oxygen hose 44 is connected to the rear bag 24 on the opposite side of the manual inflator 32, the pressure surge created by the sudden release of breathable gas from the high pressure cylinder 30 is partly absorbed in the inflation of the rear bag 24, and therefore does not cause a significant increase in pressure in the oxygen hose 44 and in the selector valve 40.

In use, the life vest 20 may be put on by a user, and the handle 50 is pulled down quickly and firmly to puncture a diaphragm (not shown) in the neck of the high pressure cylinder 30. The breathable gas is released into the rear bag 24 thereby inflating the rear bag 24. Using the mouthpiece 26 with the selector valve 40 in an initial position, the user inhales breathable gas from the rear bag 24 and exhales a mixture of oxygen and $CO_2$ into the front bag 22. The buoyancy of the life vest 20 is thereby maintained.

Both bags 22, 24 are made of a flexible, weather-resistant and gas-tight material. A pair of handles 52 are provided on the front bag 22 to allow a user to hold on to the life vest 20 by hand as if it was a pillow for example. The handles 52 are also advantageous to assist a user in squeezing the air out of one of the bags.

It is known that ambient air contains about 21% oxygen. It is also known that a recommended minimum oxygen content in breathable air is about 15%, because a lower amount could cause hallucinations. It is further known that a person breathing normally consumes about 5% of the oxygen present in ambient air, while a person hyperventilating in a panic situation absorbs only about 3%. Therefore, it is believed that in many circumstances, the air exhaled into the front bag 22 of the life vest 20 still contains oxygen and can be re-breathed again.

When the breathable gas in the high pressure cylinder 30 is a mixture of gas rich in oxygen, such as 90% oxygen for example, this gas can be re-breathed several times before it reaches the 15% lower limit. Therefore, the selector valve 40 in the life vest 20 according to the first preferred embodiment is rotated half a turn to allow the re-breathing the once-exhaled air and to allow exhaling in the rear bag 24. The selector valve 40 can be rotated once more to re-breathe the twice-exhaled gas from one bag and exhaled in the other. In other words, the selector valve 40 is rotated as required to breathe from the inflated bag and to exhale and inflate the other bag.

Referring now to FIGS. 5 to 9, the operation of the selector valve 40 will be explained in details. The selector valve 40 constitutes a base from which extends the flexible tube 28 leading to the mouthpiece 26. The selector valve 40 has a cylindrical shape, a base portion 60 and a circular dial 62 to which is mounted the flexible tube 28 and the mouthpiece 26. The base portion 60 has flat tabs 64 extending therefrom. These tabs 64 are sewn, glued or bonded to the life vest 20 to retain the selector valve 40 to the life vest 20. A pair of hose nipples 66 extend radially from the base portion 60. The exhaled air hose 42 and the oxygen hose 44 are mounted to these hose nipples 66.

Figure 9:
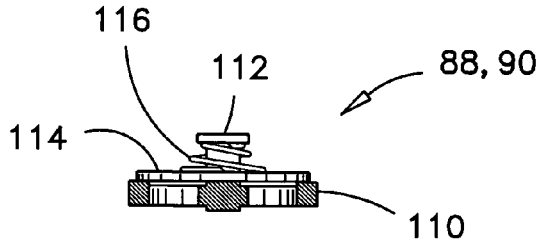
FIG. 9 is an enlarged diametrical cross-section view of a check valve used in the selector valve of the first and second preferred embodiments of the present invention.
Figure 8:
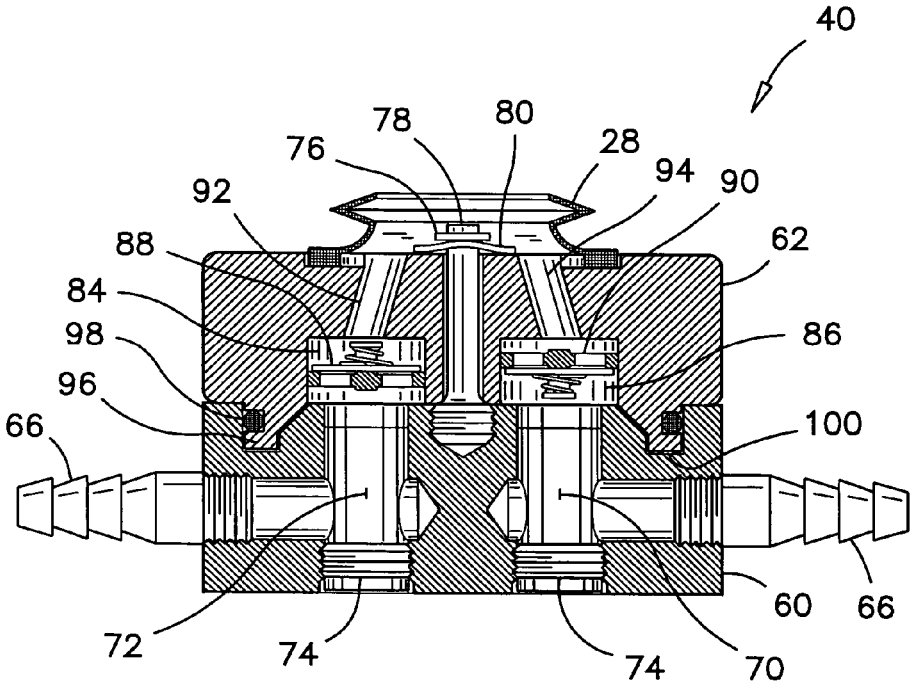
FIG. 8 is an enlarged diametrical cross-section of the selector valve illustrated in FIGS. 5–7, as seen along line 8—8 in FIG. 6.

Referring particularly to FIGS. 8 and 9, the base portion 60 of the selector valve 40 has a pair of conduits 70, 72 therein extending parallel to the axis of the valve 40. Each conduit 70, 72 communicates with one of the hose nipples 66. These conduits 70, 72 are open at their top ends and closed at their bottom ends by a pair of pipe plugs 74.

The dial 62 is mounted atop the base portion 60 and is held to the base portion 60 by a snap ring 76 and a stem 78 extending upward from the centre of the base portion 60. The snap ring 76 is engaged into a groove on the end of the stem 78. A spring disc 80 is also provided under the snap ring 76 to retain the dial 62 to the base portion 60 with a light pressure.

The dial 62 has a pair of cavities 84, 86 therein in which are respectively mounted an inhale check valve 88 and an exhale check valve 90. Each of the cavities 84, 86 communicates with a respective conduit 92 or 94 extending into the lower end of the flexible tube 28, and joining the flexible tube 28 to both check valves 88, 90. The dial 62 has a shoulder 96 on its bottom surface and an O-ring 98 circling that shoulder. The shoulder 96 and the O-ring 98 have dimensions to mount into a circular groove 100 in the upper surface of the base portion 60 so to seal the dial 62 to the base portion 60.

Each of the check valves 88, 90 has a valve seat 110 which is force-fitted into a respective cavity 84 or 86. A valve stem 112 extends from the valve seat. A valve disc 114 is mounted to the valve stem 112 and is urged against the valve seat 110 by a compression spring 116 fastened to the valve stem 112. The compression spring 116 is calibrated so that the valve disc 114 opens under a breathing pressure. The locations of the breathable gas cylinder 30 and of the oxygen hose 44 on opposite sides of the oxygen bag 24, and the size of the oxygen bag make it unnecessary to use stronger check valves. Consequently, the content of the life vest 20 is breathable without effort.

In use, the content of the oxygen bag 24 is inhaled first. The dial 62 is rotated half a turn to interchange to positions of the check valves 88 and 90. Then, the content of the front bag 22 can be re-breathed, while exhaling into the oxygen bag 24. In extreme situations, as explained before, the dial 62 can be rotated back to its initial position to re-breathe the exhaled gas a second time, and still find in it a quantity of oxygen gas.

Figure 10:
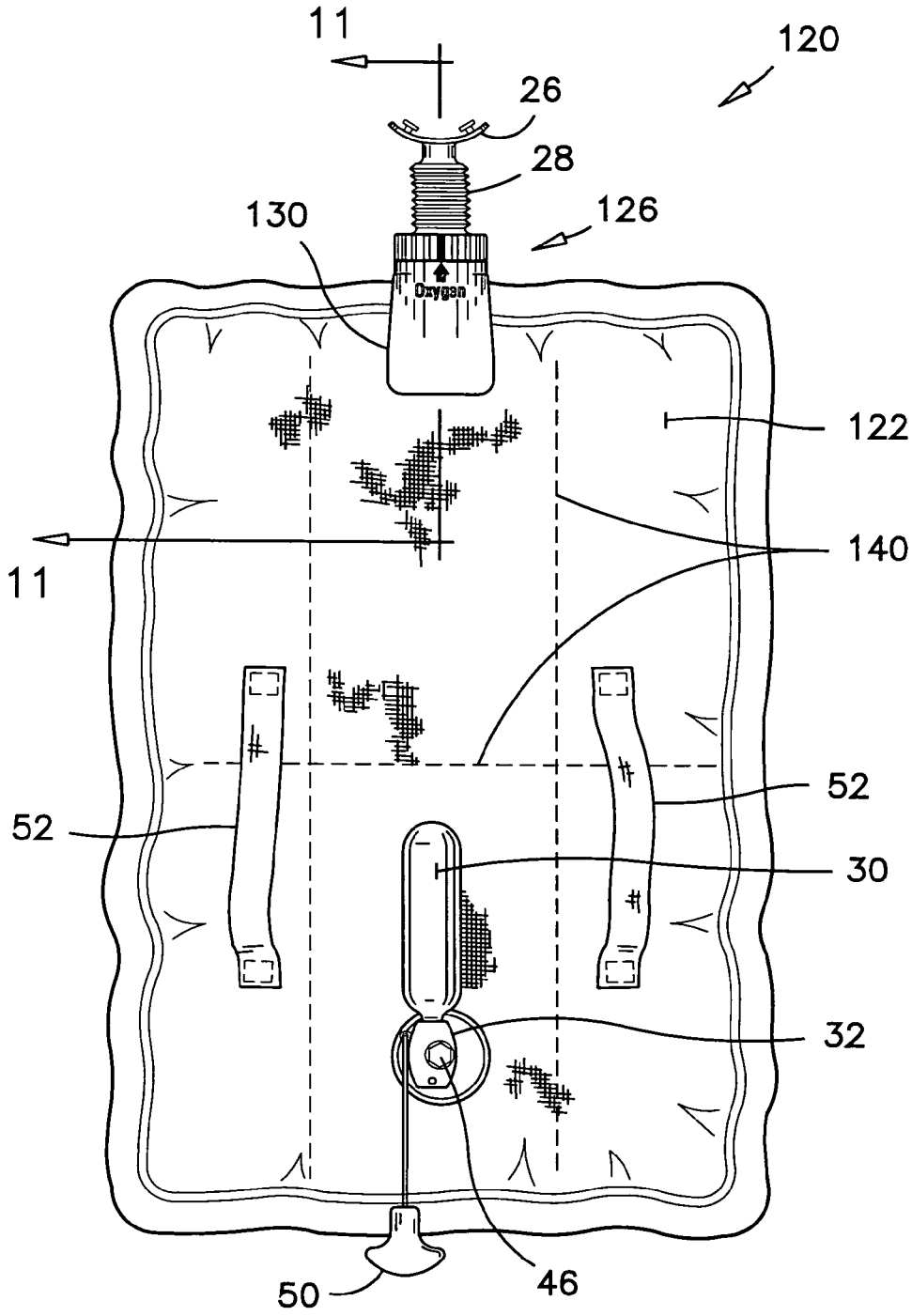
FIG. 10 is a front view of the floatation and breathing device according to the second preferred embodiment of the present invention.
Figure 11:
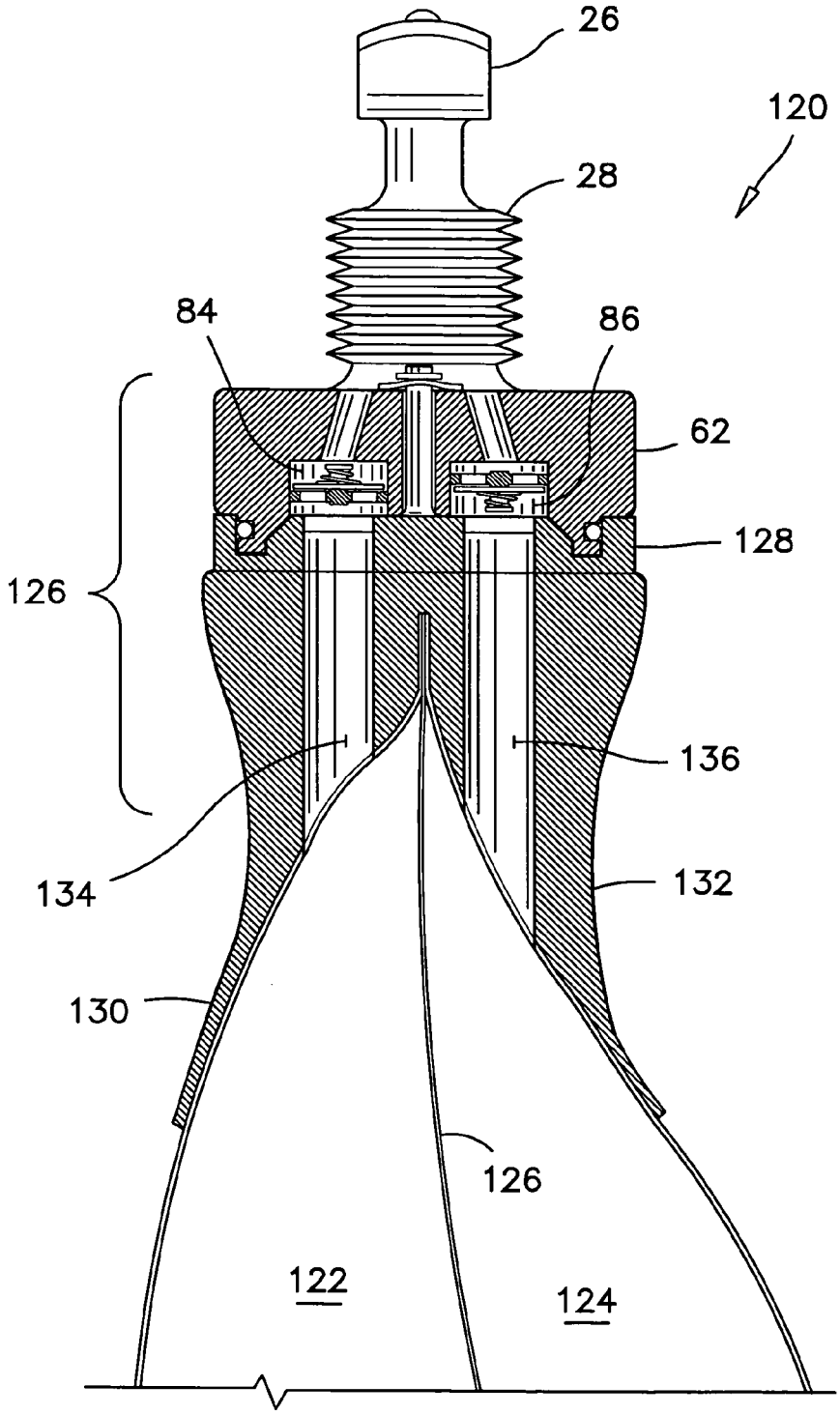
FIG. 11 is a cross-section view of the selector valve used in the second preferred embodiment.
Figure 12:
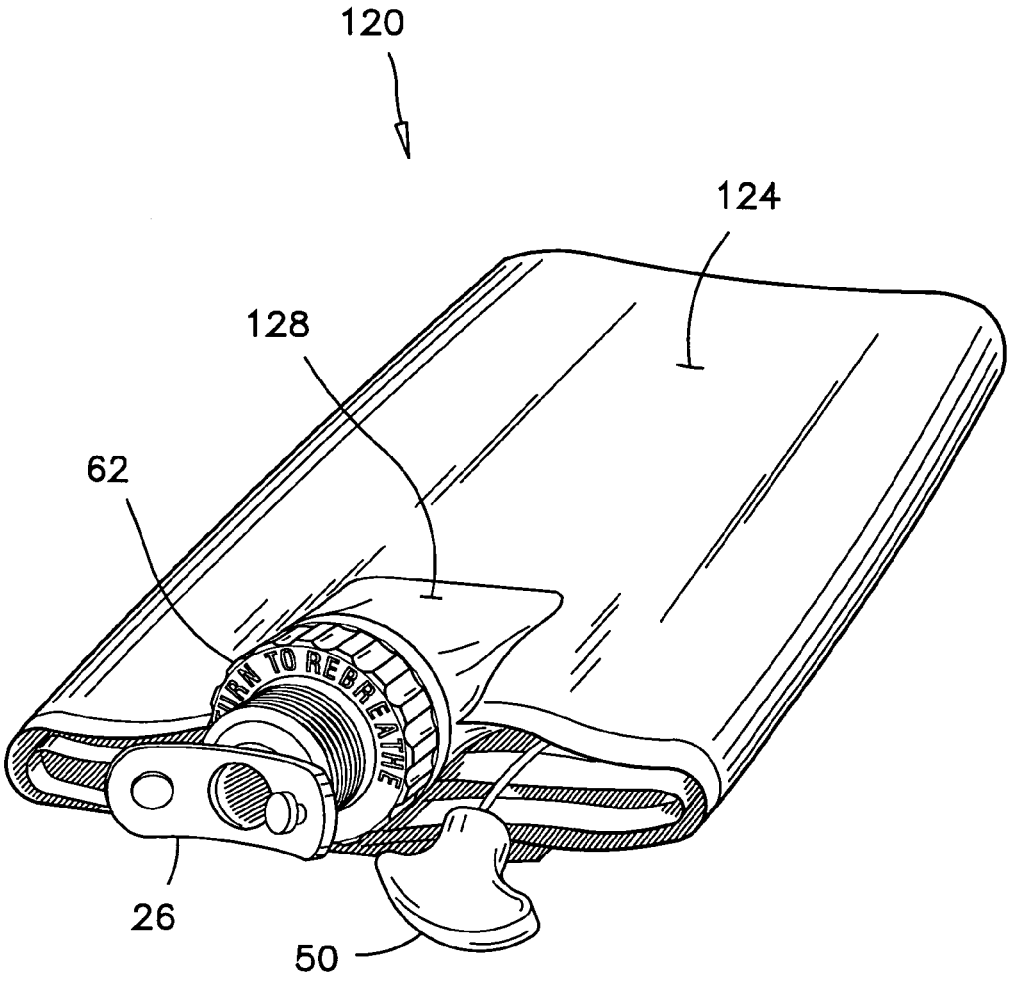
FIG. 12 illustrates the floatation and breathing device according to the second preferred embodiment in a folded mode.

Referring now to FIGS. 10–12, the floatation and breathing device according to the second preferred embodiment will be described. The second preferred floatation and breathing device 120 has the shape of a pillow, and is referred to herein as the pillow 120. This pillow also has a front compartment 122 and a rear compartment 124 separated from each other by a gas-tight membrane 126. Each of the compartments, also referred to herein as bags for corresponding to the bags in the first preferred embodiment, has a volume sufficiently large to receive 660 cubic inches of gas at atmospheric pressure. Both compartments or bags 122, 124 are made of a flexible, weather-resistant and gas-tight material.

A mouthpiece 26 and a flexible tube 28 are mounted to a selector valve 126 which is bonded to the upper end of the pillow 120. A high pressure breathable gas cylinder 30, a manual inflator 32, and a manifold valve 46 as previously described, are mounted to the bottom end of the pillow 120. The breathable gas cylinder 30 in this embodiment also contains about 4.85 cubic inches of oxygen-rich breathable gas at a pressure of about 2000 psi. A pair of handles 52 are provided to allow a user to retain the pillow against himself/herself by hand.

The selector valve 126 is similar in structure to the previously described selector valve 40 except that the base portion 128 thereof has two segments 130, 132 extending astride the top end of the pillow, with a conduit 134, 136 extending in each segment joining respectively the valve cavities 84, 86 to the compartments 122, 124. The base portion 128 of the valve is made of a material which can be vulcanized or otherwise bonded to the material of the pillow 120.

The pillow 120 is foldable in half and then in three segments as suggested by the fold lines 140 illustrated in FIG. 10 to obtain a compact arrangement as illustrated in FIG. 12. In the folded mode, the pillow 120 is easily packaged in a pouch (not shown) for example and stowed away. In the folded mode, the mouthpiece 26 and the handle 50 of the manual inflator 32 are clearly visible at one end of the package, and therefore, its use and purpose are self-explanatory.

Because of the location of the manual inflator 32 on the bottom end of the front face of the pillow 120, the operation of the manual inflator 32 causes the pillow 120 to unfold and to expand on its own from a folded form. An inscription on the dial 62 reads "½ TURN TO REBREATHE". This inscription is clearly visible when the pillow 120 is pulled out of its storing pouch, such that a user can understand at a glance the procedure to re-breathe the air from the exhaled air compartment 124 when the oxygen compartment becomes empty.

As to other manner of usage and operation of the present invention, the same should be apparent from the above description and accompanying drawings, and accordingly further discussion relative to the manner of usage and operation of the invention would be considered repetitious and is not provided.

While two embodiments of the present invention have been illustrated and described herein above, it will be appreciated by those skilled in the art that various modifications, alternate constructions and equivalents may be employed without departing from the true spirit and scope of the invention. For example, the check valve described and illustrated herein is only one type of check valves available for mounting in the lifesaving devices according to the present invention. Also, it will be understood that although the operation of the lifesaving devices as described herein consists of breathing from one bag and exhaling in the other, the selector valve can be used to inflate both bags, to increase the buoyancy of the device in circumstances where floatation is more important than oxygen supply. Therefore, the above description and the illustrations should not be construed as limiting the scope of the invention which is defined by the appended claims.

I claim:

1. A lifesaving floatation and breathing device comprising;

first and second inflatable bags attached to each other and each having a bag volume;

conduit means communicating with both said first and second inflatable bags;

a mouthpiece mounted to said conduit means;

a pressurized gas container filled with breathable gas affixed to said first bag, said pressurized gas container having a gas volume and a gas pressure therein, and means mounted to said pressurized gas container for transferring said breathable gas from said pressurized gas container into said first bag;

wherein said bag volume of each of said inflatable bags is a mathematical product of said gas volume inside said pressurized gas container and a ratio of said gas pressure inside said pressurized gas container over atmospheric pressure.

2. The lifesaving floatation and breathing device as claimed in claim 1, wherein said conduit means comprises a selector valve.

3. The lifesaving floatation and breathing device as claimed in claim 2, wherein said conduit means also comprises a first conduit communicating with said first bag and a second conduit communicating with said second bag, and first and second check valves respectively mounted in said first and second conduits; said check valves being mounted in opposite air-flow orientations relative to each other for controlling a gas flow in said mouthpiece to and from said bags.

4. The lifesaving floatation and breathing device as claimed in claim 3, wherein said selector valve has means to invert a position of said check valves relative to said first and second conduits to allow a re-breathing of previously exhaled gas in one of said bags.

5. The lifesaving floatation and breathing device as claimed in claim 4, wherein said means to invert a position of said check valves comprises a rotatable circular dial.

6. The lifesaving floatation and breathing device as claimed in claim 5 further comprising a flexible and extensible hose mounted between said mouthpiece and said dial.

7. The lifesaving floatation and breathing device as claimed in claim 6, further comprising means to retain said selector valve to at least one of said bags.

8. The lifesaving floatation and breathing device as claimed in claim 1, further comprising a handle attached to a surface of one of said bags.

9. A lifesaving floatation and breathing device comprising, first and second inflatable bags attached to each other and each having a bag volume and a shape of a life vest;

conduit means communicating with both said first and second inflatable bags and comprising a selector valve;

a mouthpiece mounted to said conduit means;

a pressurized gas container filled with breathable gas affixed to one of said bags, and having a gas volume and a gas pressure therein, and means mounted to said pressurized gas container for transferring said breathable gas from said pressurized gas container into said first bag.

10. The lifesaving floatation and breathing device as claimed in claim 9 wherein said bags comprise a front bag and a rear bag relative to each other, each having a horseshoe shape and first and second lower ends on opposite sides thereof.

11. The lifesaving floatation and breathing device as claimed in claim 10 wherein said pressurized gas container has means to introduce said breathable gas in said first end of said horseshoe shape in said rear bag.

12. The lifesaving floatation and breathing device as claimed in claim 11, wherein said conduit means comprises first and second hoses respectively mounted between said selector valve and each of said front and rear bags, and said hose between said selector valve and said rear bag being affixed to said second end of said horseshoe shape.

13. The lifesaving floatation and breathing devices as claimed in claim 12, wherein said conduit means also comprises a first conduit communicating with said first hose and a second conduit communicating with said second hose, and first and second check valves respectively mounted in said first and second conduits; said check valves being mounted in opposite air-flow orientations relative to each other for controlling a gas flow in said mouthpiece to and from said bags, and said selector valve has means to invert a position of said check valves relative to said first and second conduits to allow re-breathing of previously exhaled gas.

14. The lifesaving floatation and breathing device as claimed in claim 11, wherein said conduit means further comprises a selector valve.

15. The lifesaving floatation and breathing devices as claimed in claim 14, wherein said conduit means also comprises a first conduit communicating with said first bag and a second conduit communicating with said second bag, and first and second check valves respectively mounted in said first and second conduits; said check valves being mounted in opposite air-flow orientations relative to each other for controlling a gas flow in said mouthpiece to and from said bags, and said selector valve has means to invert a position of said check valves relative to said first and second conduits to allow re-breathing of previously exhaled gas.

16. The lifesaving floatation and breathing device as claimed in claim 9, wherein said bag volume of each of said bags is a mathematical product of said gas volume inside said pressurized gas container and a ratio of said gas pressure inside said pressurized gas container over atmospheric pressure.

17. A lifesaving floatation and breathing device comprising, first and second inflatable bags each having a bag volume; said first and second inflatable bags being superimposed over each other and jointly defining a shape of a pillow;

conduit means communicating with both said first and second inflatable bags;

a mouthpiece mounted to said conduit means;

a pressurized gas container filled with breathable gas affixed to one of said bags, and having a gas volume and a gas pressure therein, and means attached to said pressurized gas container for transferring said breathable gas from said pressurized gas container into one of said bags, wherein said bag volume is a mathematical product of said gas volume inside said pressurized container and a ratio of said gas pressure inside said pressurized container over atmospheric pressure.

18. The lifesaving floatation and breathing device as claimed in claim 17 where said inflatable bags comprise a front bag and a rear bag each having an upper end and a lower end, and said mouthpiece being bonded to said upper ends.

19. The lifesaving floatation and breathing device as claimed in claim 18 wherein said pressurized gas container has means to introduce said breathable gas in said lower end of said front bag.

20. The lifesaving floatation and breathing device as claimed in claim 17, wherein said first and second inflatable bags have a common membrane therein.

* * * * *